United States Patent [19]

Hamada

[11] Patent Number: 4,969,427

[45] Date of Patent: Nov. 13, 1990

[54] CYLINDER HEAD OF A FOUR-CYCLE ENGINE

[75] Inventor: Shigeaki Hamada, Hamamatsu, Japan

[73] Assignee: Suzuki Jidosha Kogyo Kabushiki Kaisha, Shizuoka, Japan

[21] Appl. No.: 327,341

[22] Filed: Mar. 22, 1989

[30] Foreign Application Priority Data

Mar. 31, 1988 [JP] Japan ..... 63-79141

[51] Int. Cl.[5] ..... F01L 1/02

[52] U.S. Cl. ..... 123/90.27; 123/432

[58] Field of Search ..... 123/432, 308, 90.27, 123/193 H

[56] References Cited

U.S. PATENT DOCUMENTS

| | | | |
|---|---|---|---|
| 4,553,515 | 11/1985 | King et al. | 123/432 |
| 4,617,896 | 10/1986 | Yoshikawa | 123/432 |
| 4,649,872 | 3/1987 | Solheim | 123/432 |
| 4,667,636 | 5/1987 | Oishi et al. | 123/432 |
| 4,681,069 | 7/1987 | Honma | 123/90.27 |
| 4,741,302 | 5/1988 | Oda et al. | 123/432 |
| 4,773,360 | 9/1988 | Heimburg | 123/90.27 |
| 4,809,663 | 3/1989 | De Tomaso | 123/432 |
| 4,819,591 | 4/1989 | Valentine | 123/90.27 |

FOREIGN PATENT DOCUMENTS

| | | |
|---|---|---|
| 49-15162 | 4/1974 | Japan . |
| 52-145207 | 11/1977 | Japan . |
| 58-135309 | 8/1983 | Japan . |

*Primary Examiner*—E. Rollins Cross

*Attorney, Agent, or Firm*—Flynn, Thiel, Boutell & Tanis

[57] ABSTRACT

A cylinder head for a four-cycle engine having combustion chamber holes formed in the lower surface thereof, and mounting at least one rotatable cam shaft along the upper surface. The cylinder head may also mount a rocker shaft to permit use with either a 1-cam 2-valve engine or a 1-cam 4-valve engine.

3 Claims, 4 Drawing Sheets

CYLINDER HEAD OF A FOUR-CYCLE ENGINE

FIELD OF THE INVENTION

This invention relates to a cylinder head of a four-cycle engine, more particularly to a cylinder head of a four-cycle engine installed in a cylinder block, forming a combustion chamber for burning mixed gas, equipped with intake and exhaust passages and intake and exhaust valves, and furnished with a valve operating system composed of a cam and rocker arms at its upper part.

BACKGROUND OF THE INVENTION

A cylinder head of a four-cycle engine is, like a cylinder block, directly exposed to combustion gas at a high temperature and a high pressure, and receives a high gas pressure and thermal load. Accordingly, the cylinder head requires characteristics closer to those needed in a cylinder block, and the cylinder heads are often manufactured of cast iron like the cylinder block. But different from the cylinder block, the cylinder head receives a larger amount of heat because the combustion of the mixed gas finishes near the top dead center of the piston, and it has no sliding part with the piston. Cylinder heads made of a lightweight aluminum alloy molding with a superior heat releasing property are therefore mainly used.

One known cylinder head is disclosed in Japanese Patent Publication No. 49-15162. The reciprocating internal combustion engine disclosed in this publication employs an oscillating action for the exhaust valve requiring less severity and a direct cam action for the intake valve to realize an overhead cam shaft apparatus with a high degree of freedom in design.

Another cylinder head is disclosed in Japanese Laid-Open Patent No. 58-135309. The hemispherical combustion chamber cross flow V-type valve configuration center spark plug SOHC engine disclosed in this publication possesses two cams on one cam shaft and the exhaust valve is opened and closed by one cam and the intake valve is opened and closed by the other cam through a rocker arm.

Still another cylinder head is disclosed in Japanese Laid-Open Utility Model No. 52-145207. The hydraulic controller for automatic valve clearance regulator in the valve operating system of the internal combustion engine disclosed in this publication is designed to open a bubble separating slot near the apex of the hydraulic chamber, to connect the bubble separating slot to a relief passage, and to mount a relief valve between the hydraulic chamber and the relief passage, thereby feeding a specific hydraulic pressure without containing bubbles to the valve clearance regulator.

In cylinder heads of the conventional four-cycle engine, exclusive cylinder heads are manufactured for each kind of engine including those using one cam and a pair of intake and exhaust valves (called 1-cam 2-valve engines), those using one cam and two pairs of intake and exhaust valves (called 1-cam 4-valve engines), and those using two cams and two pairs of intake and exhaust valves (called 2-cam 4-valve engines), and exclusive machining apparatus and exclusive parts were provided for each cylinder head.

Accordingly, the manufacturing cost of exclusive machining apparatus and exclusive parts for each cylinder head are enormous, and such system are economically not advantageous.

In addition, as the exclusive parts require checking and testing respectively, the developing period is consequently prolonged, the developing period can not be shortened, a large amount of developing cost is spent and a great deal of effort is needed, and therefore such system is economically and practically not advantageous.

The cylinder heads disclosed in Japanese Patent Publication No. 49-15162, in Japanese Laid-Open Patent No. 58-135309 and in Japanese Laid-Open Utility Model No. 52-145207 were designed without the aim of common use of the machining apparatus and components.

It is hence a primary object of this invention to provide cylinder heads for four-cycle engines not only economically advantageous so as to permit reducing the manufacturing cost, but also economically and practically advantageous by not requiring checking and testing for each type of part, by being capable of shortening the development period, and by being capable of reducing the period and effort for development by designing common machining apparatus and parts.

SUMMARY OF THE INVENTION

To achieve the above object, the present invention provides a cylinder head of a four-cycle engine having a rocker arm which opens and closes a valve by pressing the valve stem end depending on the action of a cam, wherein a cylinder head for a valve operating system using one cam shaft is composed of a cam shaft equipped with said cam, a cam cap for covering the cam shaft, at least one each of first and second rocker arms respectively linked to the cam shaft, an intake valve for opening and closing an air intake passage by the first rocker arm, an exhaust valve for opening and closing an exhaust passage by the second rocker arm, rocker shafts mounting the first and second rocker arms thereon respectively, and a spark plug installed by being inclining by a specified mounting angle from the vertical centerline of said cylinder head.

The present invention is moreover intended to provide a cylinder head of a four-cycle engine having a rocker arm which opens and closes a valve by pressing the valve stem end depending on the action of a cam, wherein a cylinder head for a valve operating system which uses two intake valves and two exhaust valves is composed of at least one cam shaft equipped with said cam, at least one cam cap for covering the cam shaft, two pairs of first and second rocker arms linked to the cam shaft, two intake valves for opening and closing an intake passage by the first rocker arms, two exhaust valves for opening and closing an exhaust passage by the second rocker arms, and a spark plug.

By designing the cylinder head in the above way, the machining apparatus and components for cylinder heads can be shared, and the manufacturing cost can be reduced, thereby becoming economically advantageous. In addition, checking and testing is unnecessary for each kind of part, and the development cost and effort can be reduced by shortening the developing period, thereby becoming economically and practically advantageous.

BRIEF DESCRIPTION OF THE DRAWINGS

FIGS. 1 to 8 show an embodiment of this invention, in which:

FIG. 1 is a plan view of the cylinder head of a 1-cam 2-valve engine,

FIG. 2 is a sectional view along line II—II in FIG. 1,

FIG. 3 is a sectional view along line III—III in FIG. 1,

FIG. 4 is a bottom view of a cylinder head of the 1-cam 2-valve engine,

FIG. 5 is a plan view of a cylinder head of the 1-cam 4-valve engine,

FIG. 6 is a sectional view along line VI—VI in FIG. 5,

FIG. 7 is a sectional view along line VII—VII in FIG. 5, and

FIG. 8 is a bottom view of the cylinder head of the 1-cam 4-valve engine.

DETAILED DESCRIPTION

A 1-cam 2-valve engine 2A is formed by a cylinder head 4A and a cylinder block 6A, thereby forming a combustion chamber 8A for burning mixed gas.

Figure 1:
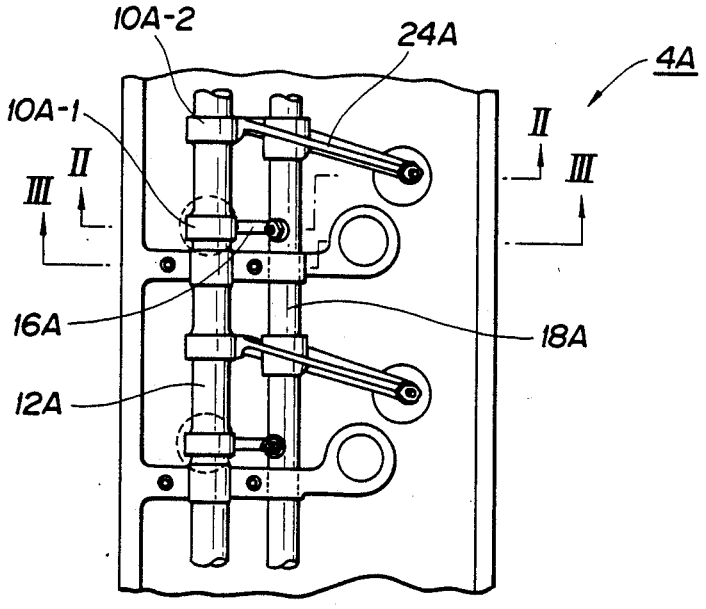
Figure 2:
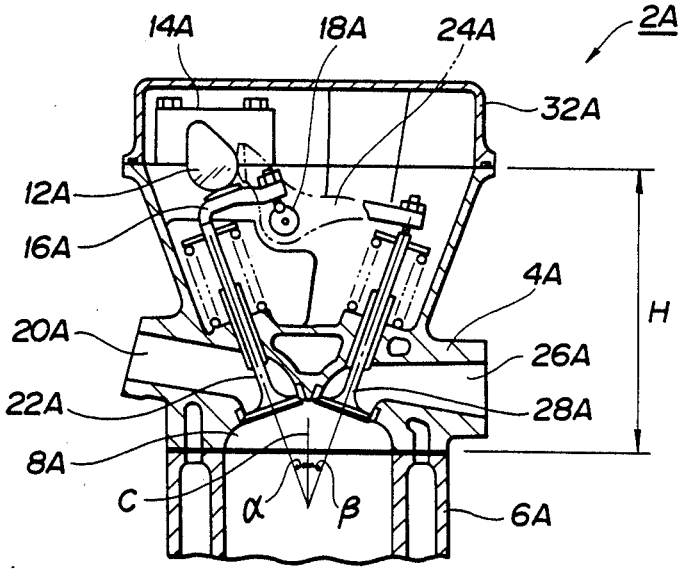
Figure 3:
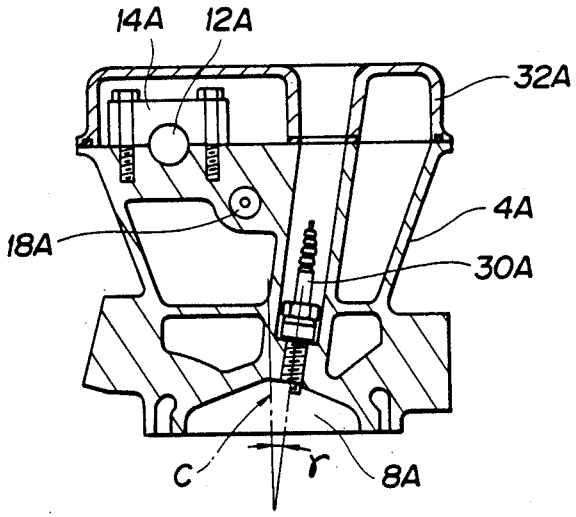

The cylinder head 4A has a height H, as shown in FIGS. 1 and 2, and a rotatable cam shaft 12A equipped with cam 10A-1 and 10A-2, and the cam shaft 12A is covered with a cam cap 14A.

A first single-arm rocker arm 16A is mounted by contacting its intermediate upper edge with the cam 10A-1. An end of the first rocker arm 16A is attached to a rocker shaft 18A, and an intake valve 22A to open and close an intake passage 20A is acted on by the other end of the rocker 16A. In the same way, a second double-arm rocker arm 24A is mounted by contacting its edge with the cam 10A-2, and an exhaust valve 28A which opens and closes an exhaust passage 26A is activated by the other end of the second rocker arm 24A.

Figure 4:
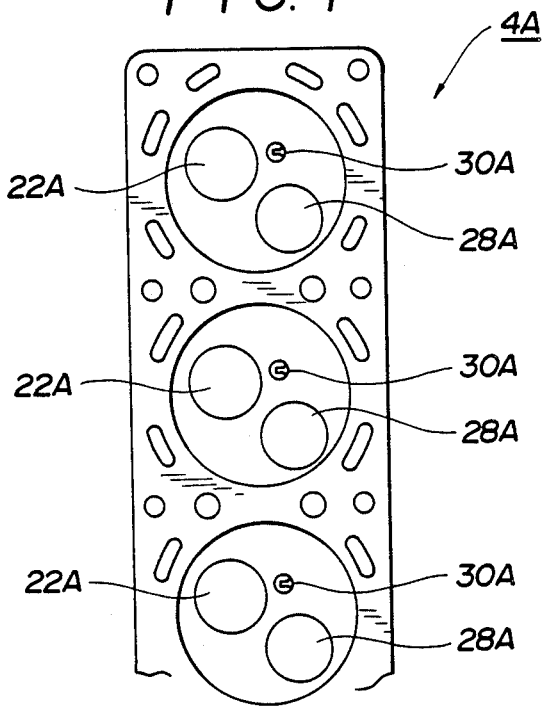

At this moment, the intake and exhaust valves 22A and 28A are, as shown in FIG. 2, disposed so as to have specified included angles $\alpha$ and $\oplus$ with respect to the longitudinal centerline C of the cylinder head 4A, and the intake valve 22A is located on the left in FIG. 4 and the exhaust valve 28A is on the right.

A spark plug 30A is installed so as to be inclined at a specified mounting angle, for example $\alpha$, from the longitudinal centerline C of the cylinder head 4A, thereby composing the 1-cam 2-valve engine 2A.

FIG. 4 shows a cylinder head 4A of a 1-cam 2-valve engine 2A with three cylinders.

According to FIGS. 5 to 8, an engine using one cam and two pairs of intake and exhaust valves (called a 1-cam 4-valve engine) is explained.

A 1-cam 4-valve engine 2B is composed of a cylinder head 4B and a cylinder block 6B, thereby forming a combustion chamber 8B for burning mixed gas.

Figure 5:
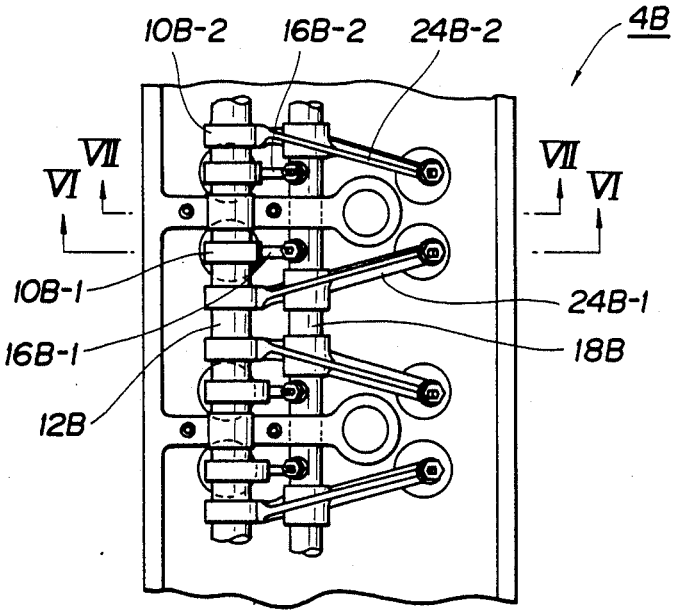
Figure 6:
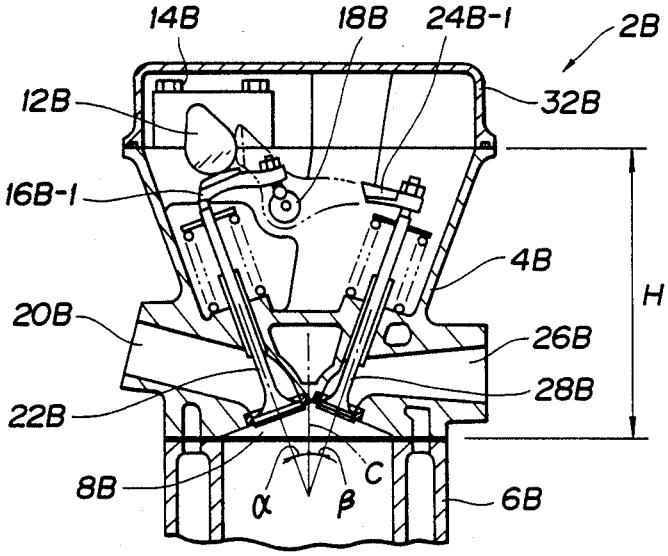
Figure 7:
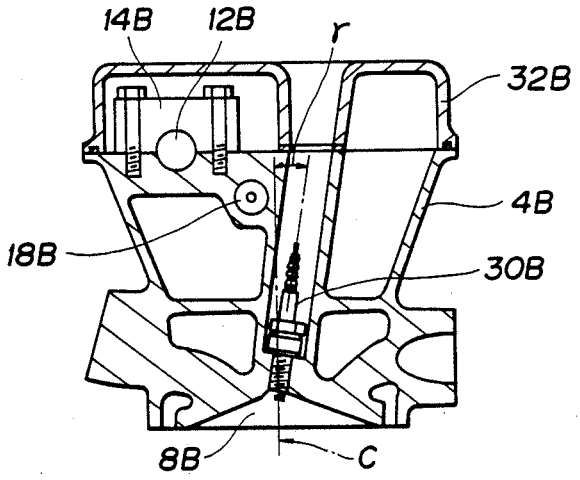

The cylinder head 4B possesses a cam shaft 12B equipped with cams 10B-1 and 10B-2, as shown in FIGS. 5 and 6, and the cam shaft 12B is covered with a cam cap 14B.

Two first rocker arms 16B-1, 16B-2 are mounted so that their intermediate upper edges contact the two cams 10B-1 and 10B-2 respectively. One end of each of the first rocker arms 16B-1 and 16B-2 are attached to a rocker shaft 18B. The other ends respectively actuate two intake valves 22B-1, 22B-2 to open and close intake passages 20B-1, 20B-2. Two second rocker arms 24B-1 and 24B-2 are mounted so that their one ends contact the two cams 10B-1 and 10B-2 respectively, and two exhaust valves 28B-1 and 28B-2 open and close respective exhaust passages 26B-1 and 26B-2 due to their actuation by the other ends of the second rocker arms 24B-1 and 24B-2.

Figure 8:
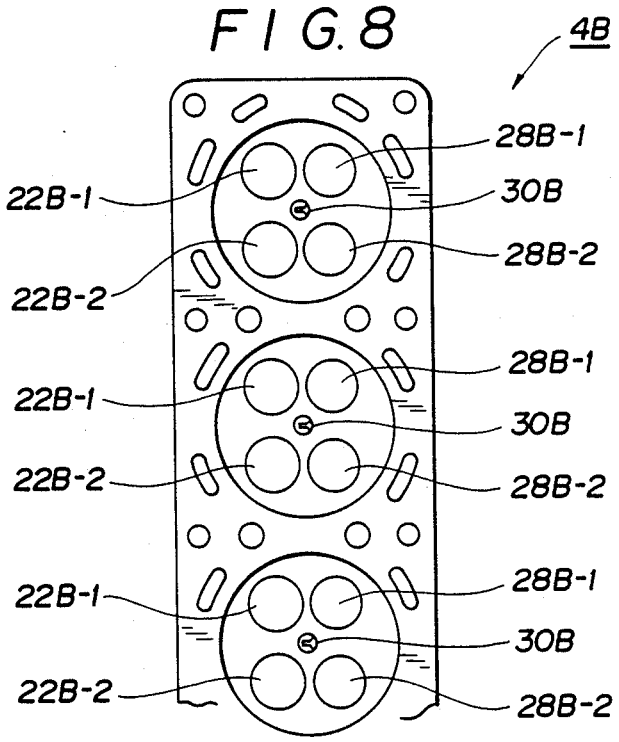

At this moment, the intake and exhaust valves 22B and 28B are disposed, as shown in FIG. 6, so as to possess specified included angles $\alpha$ and $\beta$ with respect to the longitudinal centerline C of the cylinder head 4B, and the intake valves 22B-1, 22B-2 are located on the left in FIG. 8 and the exhaust valves 28B-1, 28B-2 are on the right.

A spark plug 30B is disposed so as to be inclined at a specified mounting angle, for example $\alpha$, from the longitudinal centerline C of the cylinder head 4B, thereby composing the 1-cam 4-valve engine 2B.

FIG. 8 shows a cylinder head 4B of the 1-cam 4-valve engine 2B with three cylinders.

In this drawing, numeral 32B denotes a cylinder head cover positioned over the upper part of the cylinder head 4B.

When designed in this way, for the cylinder head 4A of the 1-cam 2-valve engine 2A and the cylinder head 4B of the 1-cam 4-valve engine 2B, the shapes and the attaching positions of the first and second rocker arms 16A, 24A, 16B-1, 16B-2, 24B-1 and 24B-2, the center points of the rocker shafts 18A and 18B, and the mounting angles $\alpha$ for the spark plugs 30A and 30B are identical respectively. As a result, the parts used in the cylinder heads 4A and 4B are applicable in common, and the test results on either one of the 1-cam 2-valve engine 2A or the 1-cam 4-valve engine 2B can be used as functional performances for both, including the behavior and abrasion of the components, so that the durability and performances can be accurately checked or estimated.

The machining apparatus and parts used in the cylinder heads 4A and 4B can be shared, thereby greatly reducing the manufacturing cost in comparison with independently designed cylinder heads, which is economically advantageous.

Moreover, when the included angles $\alpha$ and $\beta$ of the intake and exhaust valves 22 and 28 or the mounting angles $\alpha$ of the spark plug 30 are identical, it is relatively easy to change in the longitudinal direction, and the machining can be easily modified from the 1-cam 4-valve engine 2B to the 1-cam 2-valve engine 2A.

According to the present invention, as explained in details above, the cylinder heads for engines with different specifications are composed so as to use common machining apparatus and parts.

As a result, the manufacturing cost can be reduced in comparison with those of independent design, and therefore it is economically advantageous. In addition, when confirming and estimating the durability and performances of the parts commonly used, the checking and testing of the parts with one type of specification is enough, and testing on each type of engine with different specifications is needless.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A cylinder head assembly for an internal combustion engine, comprising an elongate cylinder head arrangement having upper and lower surfaces and a central plane which extends in the elongate direction in substantially perpendicular relationship to the lower surface, a plurality of combustion chamber openings opening inwardly into the cylinder head arrangement from the lower surface in spaced relationship generally along the central plane, an inlet passage formed in said cylinder head arrangement and communicating with a respective said combustion chamber opening and having a poppet-type inlet valve movably associated therewith, the inlet valve having a stem projecting upwardly toward the upper surface, an exhaust passage formed in said cylinder head arrangement and communicating with a respective said combustion chamber opening and having a poppet-type exhaust valve movably associated therewith, said exhaust valve having a stem projecting upwardly of the cylinder head arrangement, said inlet and exhaust valves having upper ends disposed in sidewardly offset relationship on opposite sides of said central plane, an elongate cam shaft disposed adjacent the upper surface of said cylinder head arrangement and rotatably supported thereon, said cam shaft extending generally parallel with but being sidewardly offset to one side of said central plane, first and second cams secured to and rotatable with said cam shaft, an elongate rocker support shaft disposed adjacent the upper surface of said cylinder head arrangement and supported thereon, said rocker support shaft extending generally parallel with said cam shaft and being disposed sidewardly between said cam shaft and said central plane, a single-arm rocker mounted adjacent one end thereof to said rocker support shaft and engaged at the other end thereof with the upper end of one of said intake and exhaust valves, said first cam being maintained in sliding engagement with said single-arm rocker at a location between the ends thereof, a double-arm rocker mounted at an intermediate part thereof to said rocker support shaft and having a first arm which projects outwardly from said rocker support shaft and adjacent its free end is engaged with said second cam, said double-arm rocker having a second arm which projects outwardly from said rocker support shaft and adjacent its free end is engaged with the upper end of the other of said intake and exhaust valves, a spark plug hole extending downwardly from the upper surface through said cylinder head arrangement for communication with a respective combustion chamber opening, and a spark plug mounted adjacent the lower end of said hole for communication with the combustion chamber opening.

2. An arrangement according to claim 1, wherein said spark plug hole and said spark plug are disposed so that the longitudinal extent thereof is inclined at a small angle relative to the central plane as it projects upwardly with said spark plug being disposed in slightly sidewardly offset relationship from said rocker support shaft.

3. An arrangement according to claim 1, wherein each said combustion chamber includes a pair of intake passages which are spaced apart in a lengthwise direction of the cylinder and are disposed on one side of said central plane and each of which has a said intake valve movably associated therewith, and a pair of exhaust passages which are spaced apart in the lengthwise direction of the cylinder head and are disposed on the other side of said central plane and each of which has a separate said exhaust valve movably associated therewith, the cam shaft having axially spaced pairs of said first and second came thereon, and a pair of said single-arm rockers and said double-arm rockers being mounted on said rocker support shaft so that each single arm rocker cooperates with a respective said intake valve and first cam and each double-arm rocker cooperates with a respective said second cam and exhaust valve.

* * * * *

UNITED STATES PATENT AND TRADEMARK OFFICE

CERTIFICATE OF CORRECTION

PATENT NO. : 4,969,427

DATED : November 13, 1990

INVENTOR(S) : Shigeaki HAMADA

It is certified that error appears in the above-identified patent and that said Letters Patent is hereby corrected as shown below:

Column 6, line 17; after "from" insert the following ---said central plane on the side thereof which is opposite from---.

Column 6, line 30; change "camė" to ---cams---.

Signed and Sealed this

Fourteenth Day of July, 1992

*Attest:*

*Attesting Officer*

DOUGLAS B. COMER

*Acting Commissioner of Patents and Trademarks*